US008689890B2

(12) United States Patent
Tulapurkar et al.

(10) Patent No.: US 8,689,890 B2
(45) Date of Patent: Apr. 8, 2014

(54) RUNNING TOOL WITH FEEDBACK MECHANISM

(75) Inventors: Chetan Tulapurkar, Karnataka (IN); Tariq Ansari, Karnataka (IN); Shripad Hegde, Karnataka (IN); Mahesh Bhat, Karnataka (IN); Nicholas Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 531 days.

(21) Appl. No.: 12/967,665

(22) Filed: Dec. 14, 2010

(65) Prior Publication Data

US 2012/0145411 A1 Jun. 14, 2012

(51) Int. Cl.
*E21B 23/03* (2006.01)

(52) U.S. Cl.
USPC ..... 166/381; 166/113; 166/255.2

(58) Field of Classification Search
USPC ..... 166/381, 341, 255.2, 113
See application file for complete search history.

(56) References Cited

U.S. PATENT DOCUMENTS

| | | | | |
|---|---|---|---|---|
| 2,650,664 | A * | 9/1953 | Sorensen | 166/128 |
| 4,520,869 | A | 6/1985 | Svenson | |
| 4,875,524 | A | 10/1989 | Bradley et al. | |
| 5,238,062 | A | 8/1993 | Reinholdt | |
| 5,575,333 | A | 11/1996 | Lirette et al. | |
| 5,813,458 | A | 9/1998 | Smith, Jr. et al. | |
| 5,908,072 | A | 6/1999 | Hawkins | |
| 5,957,201 | A | 9/1999 | Vick, Jr. et al. | |
| 6,257,339 | B1 | 7/2001 | Haugen et al. | |
| 6,435,275 | B1 | 8/2002 | Kirk et al. | |
| 6,453,998 | B1 | 9/2002 | Reeve | |
| 6,453,999 | B1 | 9/2002 | Reinholdt | |
| 6,457,519 | B1 | 10/2002 | Buytaert | |
| 6,585,052 | B2 | 7/2003 | Angman et al. | |
| 6,637,511 | B2 | 10/2003 | Linaker | |
| 6,679,325 | B2 | 1/2004 | Buytaert | |
| 6,725,939 | B2 | 4/2004 | Richard | |
| 6,871,706 | B2 | 3/2005 | Hennessey | |
| 7,040,407 | B2 | 5/2006 | Jennings et al. | |
| 7,071,697 | B2 | 7/2006 | Rioufol et al. | |
| 7,150,323 | B2 | 12/2006 | Ford | |
| 7,219,738 | B2 | 5/2007 | Reimert | |
| 7,380,607 | B2 | 6/2008 | Thomas | |

FOREIGN PATENT DOCUMENTS

EP 2239413 A2 10/2010

OTHER PUBLICATIONS

U.S. Appl. No. 12/415,198, filed Mar. 31, 2009 "Wellhead System Having Resilient Device to Actuate a Load Member and Enable an Over-Pull Test of the Load Member".
U.S. Appl. No. 12/620,373, filed Nov. 17, 2009 "Combination Well Pipe Centralizer and Overpull Indicator".
U.S. Appl. No. 12/913,553, filed Oct. 27, 2010 "Overpull Indicator".
GB Search Report from corresponding Application No. GB1120978.0 dated Feb. 10, 2012.

* cited by examiner

*Primary Examiner* — Giovanna Wright
(74) *Attorney, Agent, or Firm* — Bracewell & Giuliani LLP

(57) ABSTRACT

A running tool has a stem for connecting to a string of conduit, a body, and a plurality of functional positions selected in response to rotation of the stem relative to the body. A feedback mechanism assembly is connected to the running tool and is operational with rotation of the stem relative to the body. The feedback mechanism assembly increases the torque required to rotate the stem relative to the body when the running tool has reached one of the plurality of its functional positions. The increased torque thereby provides a positive indication that the running tool has reached and is in the desired and proper functional position.

18 Claims, 5 Drawing Sheets

RUNNING TOOL WITH FEEDBACK MECHANISM

FIELD OF THE INVENTION

This technique relates in general to tools for running casing hangers in subsea wells, and in particular to a running tool with a feedback mechanism.

BACKGROUND OF THE INVENTION

In subsea applications, installation of various components using running tools is a very complex operation. The running tool operates on an average of 10,000 feet below the sea surface and involves many subsystems. The running tool is subjected to extreme temperatures, pressures, and other harsh environmental factors. The operation of the running tool is done at the ship level and there is presently no robust monitoring system available to monitor the operation of the running tool. Due to the large number of components involved in the complete systems, any monitoring system at ship level does not accurately inform the operator of the movements of the components of the running tool during the running tool operation.

A need exists for a technique that provides feedback of the movements of the components of the running tool to the operator during operation of the running tool. The following technique may solve one or more of these problems.

SUMMARY OF THE INVENTION

In an embodiment of the present technique, a running tool has a stem for connecting to a string of conduit, a body, and a plurality of functional positions selected in response to rotation of the stem relative to the body. A feedback mechanism assembly is connected to the running tool and is operational with rotation of the stem relative to the body. The feedback mechanism assembly is capable of increasing the torque required to rotate the stem relative to the body at the plurality of functional positions, thereby providing a positive indication that the running tool is in the proper functional position of the plurality of functional positions.

In an embodiment of the present technique, a running tool has a stem for connecting to a string of conduit. A passage extends along an axis of the stem. The running tool has a body, and a plurality of functional positions selected in response to rotation of the stem relative to the body. A feedback mechanism body is connected to the body of the running tool. The feedback mechanism body has a plurality of engagement elements. The plurality of engagement elements correspond to the plurality of functional positions of the running tool. A feedback cam is connected to the stem and the feedback mechanism body such that the feedback cam rotates simultaneously with the stem and is capable of movement axially relative to the stem and the feedback mechanism body. The feedback cam has an engagement element. The engagement element of the feedback cam is adapted to engage the plurality of engagement elements of the mechanism body corresponding to the plurality of functional positions of the running tool. The engagement of the engagement element of the feedback cam with the plurality of engage elements of the mechanism body thereby increases the torque required to rotate the stem relative to the body at the plurality of functional positions, and thereby provides a positive indication that the running tool is in the proper functional position of the plurality of functional positions.

In an embodiment of a method of the present technique, a running tool is provided with an elongated stem, a body, and a feedback mechanism assembly. The running tool has a plurality of functional positions selected in response to rotation of the stem relative to the body. The stem is connected to a string of conduit and the tool is lowered into a subsea wellhead. The conduit and the stem are rotated relative to the body to one of the plurality of functional positions of the running tool. The feedback mechanism increases the torque required to rotate the conduit and the stem relative to the body when the running tool reaches one of the plurality of functional positions, thereby providing a positive indication and feedback that the running tool is in one of the plurality of functional positions.

BRIEF DESCRIPTION OF THE DRAWINGS

So that the manner in which the features and benefits of the technique, as well as others which will become apparent, may be understood in more detail, a more particular description of the technique briefly summarized above may be had by reference to the embodiments thereof which are illustrated in the appended drawings, which form a part of this specification. It is also to be noted, however, that the drawings illustrate only various embodiments of the technique and are therefore not to be considered limiting of the technique's scope as it may include other effective embodiments as well.

DETAILED DESCRIPTION OF THE INVENTION

The present technique now will be described more fully hereinafter with reference to the accompanying drawings in which a preferred embodiment of the technique is shown. This technique may, however, be embodied in many different forms and should not be construed as limited to the embodiment set forth herein; rather, this embodiment is provided so that this disclosure will be thorough and complete, and will fully convey the scope of the technique to those skilled in the art. Like numbers refer to like elements throughout.

Figure 1:
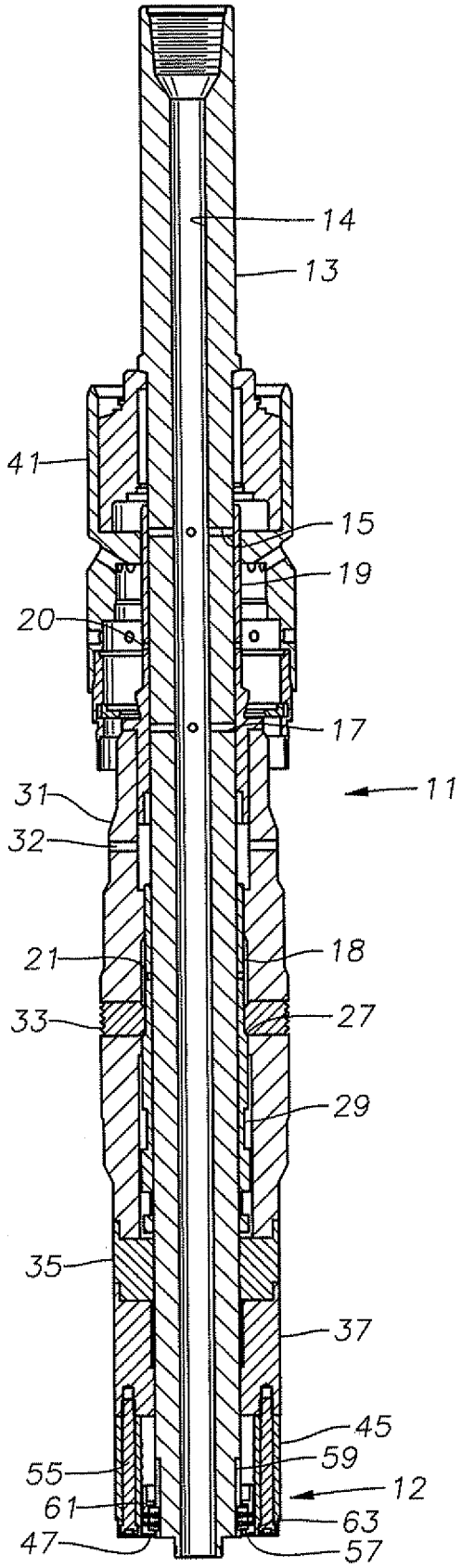
FIG. 1 is a sectional view of a running tool with a feedback mechanism constructed in accordance with an embodiment of the present technique.

Referring to FIG. 1, there is generally shown an embodiment for a running tool 11 that is used in conjunction with a feedback mechanism assembly 12 to set and internally test a easing hanger packoff. In this particular embodiment, the running tool 11 is a two-port casing hanger running tool. However, the feedback mechanism assembly 12 is not limited to this embodiment and may be employed with other running tool designs such as single or no port running tools. The running tool 11 is comprised of a stem 13. The stem 13 is a tubular member with an axial passage 14 extending therethrough. The stem 13 connects on its upper end to a string of drill pipe (not shown) and to the feedback mechanism assembly 12 on the lower end. The stem 13 has an upper stem port 15 and a lower stem port 17 positioned in and extending therethrough that allow fluid communication between the exterior and the axial passage 14 of the stem 13.

An inner cam 18 is a sleeve connected to and substantially surrounding the stem 13. In this embodiment, the inner cam 18 has axially extending slots (not shown) along portions of its inner diameter. Keys (not shown) extend radially from outer diameter portions of the stem 13 and are captured in the axially extending slots (not shown) on the inner diameter portions of the inner cam 18, such that the stem 13 and the inner cam 18 rotate in unison. The axially extending slots (not shown) allow the inner cam 18 to move axially relative to the stem 13. Portions of the outer diameter of the inner cam 18 have threads (not shown) contained therein. The inner cam 18 has an inner cam port 21 positioned in and extending therethrough that allows fluid communication between the exterior and interior of the inner cam 18. The lower portion of the inner cam 18 has a generally uniform outer diameter, except for an upwardly facing annular shoulder 27 on the outer surface of the inner cam 18. A recessed pocket 29 is positioned in the outer surface of the inner cam 18 at a select distance below the upwardly facing shoulder 27.

An inner body 19 surrounds the stem 13 and is positioned above the inner cam 18. The inner body 19 has a port 20 positioned in and extending therethrough that allows fluid communication between the exterior and the interior of the inner body 19.

An outer body 31 substantially surrounds portions of the inner cam 18 and the tool stem 13. In this embodiment, the body 31 has threads (not shown) along portions of its inner diameter that threadably engage the threads (not shown) on portions of the outer diameter of the inner cam 18, such that the inner cam 18 can rotate relative to the body 31. An outer body port 32 is positioned in and extends through the upper portion of the outer body 31 to allow fluid communication between the exterior and the interior of the outer body 31. A lower portion of the body 31 houses an engaging element 33. In this particular embodiment, engaging element 33 is a plurality of dogs, each having a smooth inner surface and a contoured outer surface. The contoured outer surface of the engaging element 33 is adapted to engage a complimentary contoured surface on the inner surface of a casing hanger (not shown) when the engagement element 33 is engaged with the casing hanger. The inner surface of the engaging element 33 is initially in contact with an outer surface portion of the inner cam 18.

The body 31, the cam 18, and the stem 13 are connected in such a manner that rotation of the stem 13 in a first direction relative to the body 31 causes the inner cam 18 to rotate in unison and simultaneously move axially upward relative to the body 31. A bearing cap 35 is securely connected to a lower portion of the body 31 and substantially surrounds portions of the inner cam 18 and the stem 13. The bearing cap 35 is an integral part of body 31 and as such, the stem 13 also rotates relative to the bearing cap 35.

A lower body 37 is connected to the lower end of the bearing cap 35. The lower body 37 is an integral part of the bearing cap 35 and as such, the stem 13 also rotates relative to the lower body 37.

A piston 41 surrounds the stem 13 and substantial portions of the inner cam 18 and the body 31. The piston 41 is an exterior sleeve and is initially in a "cocked" position relative to the stem 13 as shown in FIG. 1. The piston 41 is connected and rotates in unison with the stem 13 and is also capable of movement axially relative to the stem 13. A casing hanger packoff seal (not shown) is carried by the piston 41 and is positioned along the lower end portion of the piston 41. The packoff seal will act to seal the casing hanger to the wellhead housing when properly set.

Figure 2:
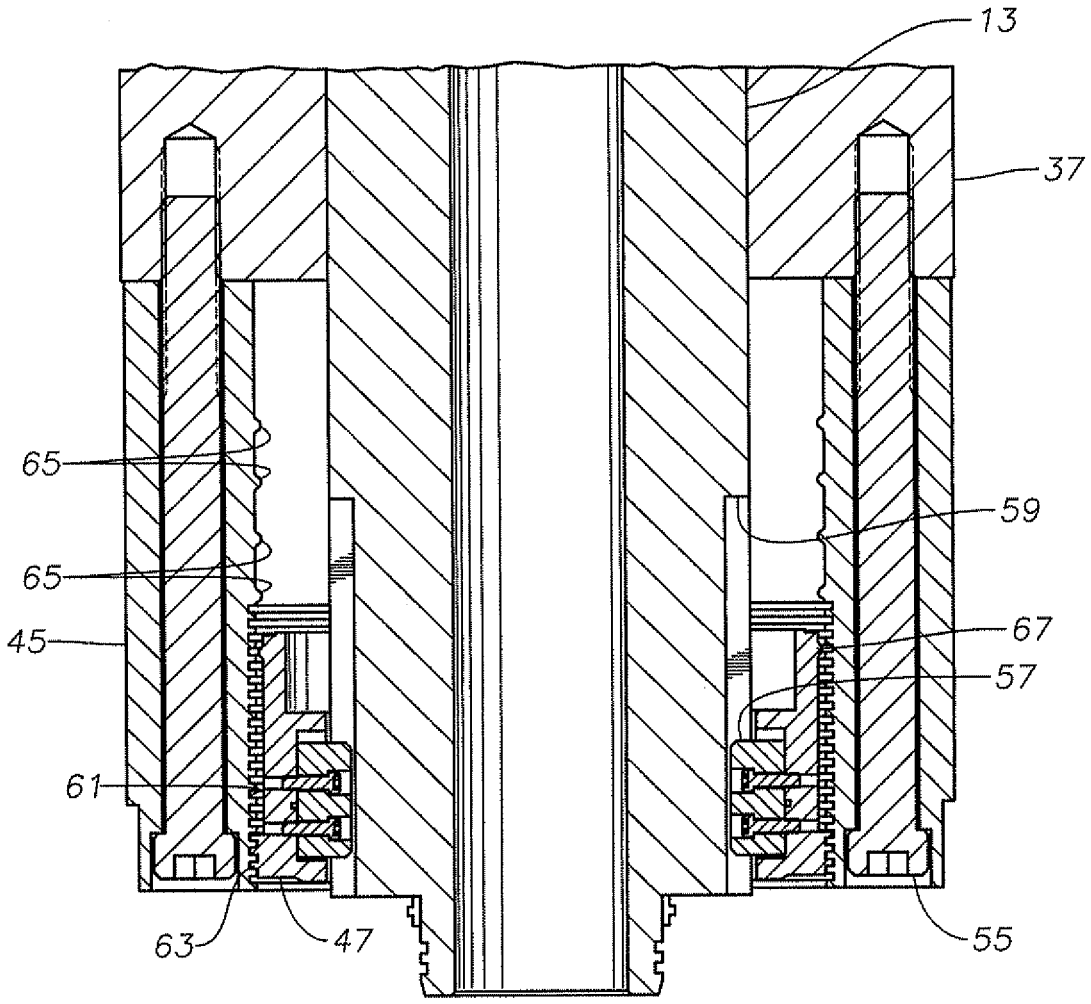
FIG. 2 is an enlarged view of the feedback mechanism of FIG. 1.

Referring to FIGS. 1 and 2, the feedback mechanism assembly 12 is comprised of a mechanism body or housing 45 and a feedback cam 47 positioned within the housing 45. In this particular embodiment, the mechanism body 45 is securely connected to the lower end of the lower body 37 by a plurality of fasteners 55 that ensure that the lower body 37 and the mechanism body 45 act in unison. The mechanism body 45 substantially surrounds the feedback cam 47 and the stem 13.

The feedback cam 47 surrounds the stem 13. The feedback cam 47 and the stem 13 are connected to one another by anti-rotation keys 57 that ensure that the stem 13 and the feedback cam 47 rotate in unison. The anti-rotation keys 57 connecting the stem 13 and actuating the feedback cam 47 are positioned in axially extending slots 59 located in the stem 13, thereby allowing the feedback cam 47 to move axially relative to the stem 13, and the mechanism body 45, as the stem 13 rotates relative to the mechanism body 45.

The lower portion of the inner diameter of the mechanism body 45 has threads 61 positioned therein. The lower portion of the outer diameter of the feedback cam 47 has threads 63 positioned therein that are in engagement with the threads 61 in the mechanism body 45. As the stem 13 rotates relative to the mechanism body 45, the threads 63 of the feedback cam 47 further engage the threads 61 on the mechanism body 45 as the feedback cam 47 moves axially relative to the mechanism body 45.

Referring to FIG. 2, the mechanism body 45 has a plurality of detents 65 positioned above the threads 61 that extend radially inward a select distance from the inner diameter of the mechanism body 45 to form annular bands. The detents 65 are vertically spaced apart from one another at a select distance and are positioned on the inner diameter of the mechanism body 45. The detents 65 are adapted to engage with the feedback cam 47 at select functional positions of the running tool 11.

The feedback cam 47 has a detent 67 positioned above the threads 63 that extends radially outward a select distance from the outer diameter of the feedback cam 47 to form an annular band. The detent 67 is adapted to engage the plurality of detents 65 on the inner diameter of the mechanism body 45 as the running tool 11 moves through various functional positions during its operation sequence.

In operation, in this embodiment, the piston 41 is initially in a "cocked" position, and the stem ports 15, 17, the upper body port 20, the outer body port 32, and the inner cam port 21 are offset from one another as shown in FIG. 1. A casing hanger packoff seal (not shown) is carried by the piston 41. The feedback mechanism assembly 12 is initially in a position with the detent 67 below the plurality of detents 65 on the mechanism body 45. The running tool 11 is lowered into a casing hanger (not shown) until the outer surface of the outer body 31 of the running tool 11 slidingly engages the inner surface of the casing hanger. The casing hanger will be secured to a string of casing that is supported by slips at the rig floor. A portion of the outer body 31 will be in contact with a shoulder or bowl in the casing hanger.

Figure 3:
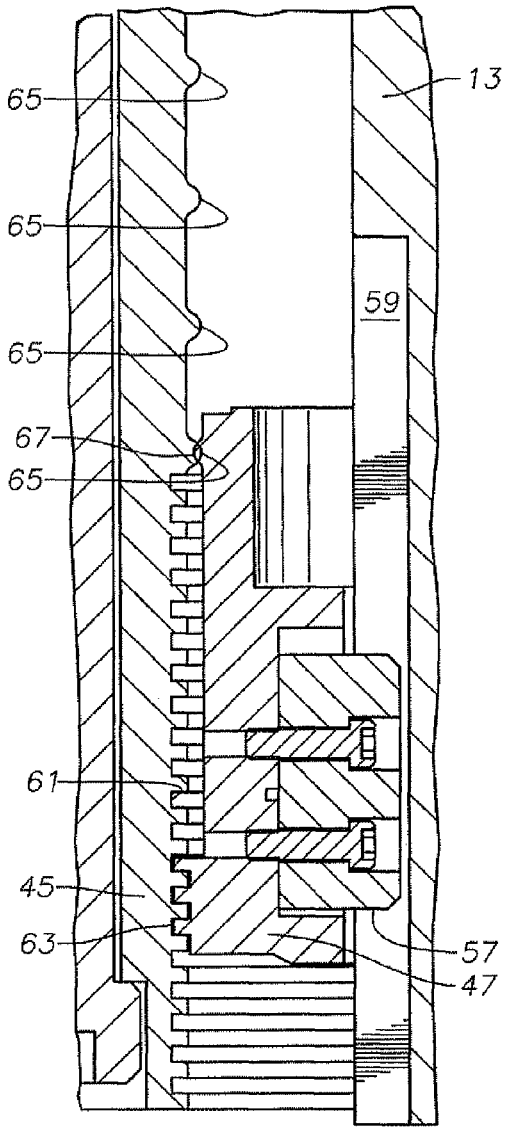
FIG. 3 is an enlarged view of a portion of the feedback mechanism in a first functional position.

Once the outer body 31 of the running tool 11 and the casing hanger are in abutting contact with one another, the stem 13 is rotated a specified number of revolutions relative to the outer body 31. Since the outer body 31, the bearing cap 35, the lower body 37, and the mechanism body 45 are all integrally connected to one another, the stem 13 simultaneously rotates a specified number of revolutions relative to the bearing cap 35, the lower body 37, and the mechanism body 45. The keys 57 ensure that as the stem 13 rotates, the feedback cam 47 rotates in unison and translates relative to the mechanism body 45. In this embodiment, as the stem 13 is rotated relative to the outer body 31, the inner cam 18 and the feedback cam 47 move longitudinally in the same direction relative to the stem 13. As the tool stem 13 and the feedback cam 47 rotate, the feedback cam 47, which is threaded to the inner surface of the mechanism body 45, begins to move axially upward relative to the mechanism body 45 due to engagement of the threads 61, 63. As the inner cam 18 moves longitudinally upward, the upwardly facing shoulder 27 on the outer surface of the inner cam 18 makes contact with the engaging element 33, forcing it radially outward and into engaging contact with a profile or recess in the inner surface of the casing hanger, thereby locking the outer body 31 to the casing hanger. Referring to FIG. 3, as the engaging element 33 (FIG. 1) engages the casing hanger, the decent 67 on the feedback cam 47 engages the first of the plurality of detents 65 on the mechanism body 45. As the detents 65, 67 engage one another, the torque required to rotate the stem 13 relative to the outer body 31, and thus the torque required to rotate the feedback cam 47 relative to the mechanism body 45 increases. The increased torque required to rotate the stem 13 to overcome the engagement of the detents 65, 67 indicates to the operator and provides positive feedback that the stem 13 has rotated to the proper functional position relative to the outer body 31. Accordingly, the increased torque also indicates to the operator and provides positive feedback that the inner cam 18 has moved axially relative to the outer body 31 the proper amount to engage the engaging element 33 with the casing hanger. As the inner cam 18 moves longitudinally upward and the stem moves longitudinally downward, the stem ports 15, 17, the upper body port 20, the inner cam port 21, and the outer body port 32 also move relative to one another.

Once the running tool 11 and the casing hanger are locked to one another, the running tool 11 and the casing hanger are lowered down the riser (not shown) until the casing hanger comes to rest in a subsea wellhead housing. The operator then pumps cement down the string, through the casing and back up an annulus surrounding the casing. The operator then prepares to set the packoff seal.

In this embodiment, in order to activate the piston 41 and set the packoff seal, the bore 14 of the running tool 11 must be closed. A solid dart or other sealing object is then dropped or lowered into the axial passage 14 of the stem 13. The solid dart or other sealing object lands in a landing sub (not shown) connected to the lower end of the stem 13, thereby sealing the lower end of stem 13. The stem 13 is then rotated a specified number of additional revolutions in the same direction as before. As the stem 13 is rotated relative to the body 31, the inner cam 18 and the feedback cam 47 move further longitudinally relative to stem 13 and the mechanism body 45, and the detents 65, 67 that were engaged with one another disengage, decreasing the amount of torque required to rotate the stem 13 relative to the body 31. As the stem 13 moves longitudinally downward, the stem ports 15, 17, the upper body port 20, the inner cam port 21, and the outer body port 32 also move relative to one another. The upper stem port 15 aligns with upper body port 20, allowing fluid communication from the axial passage 14 of the stem 13, through the stem 13, into and through the upper body 19, and into the chamber of the piston 41.

Figure 4:
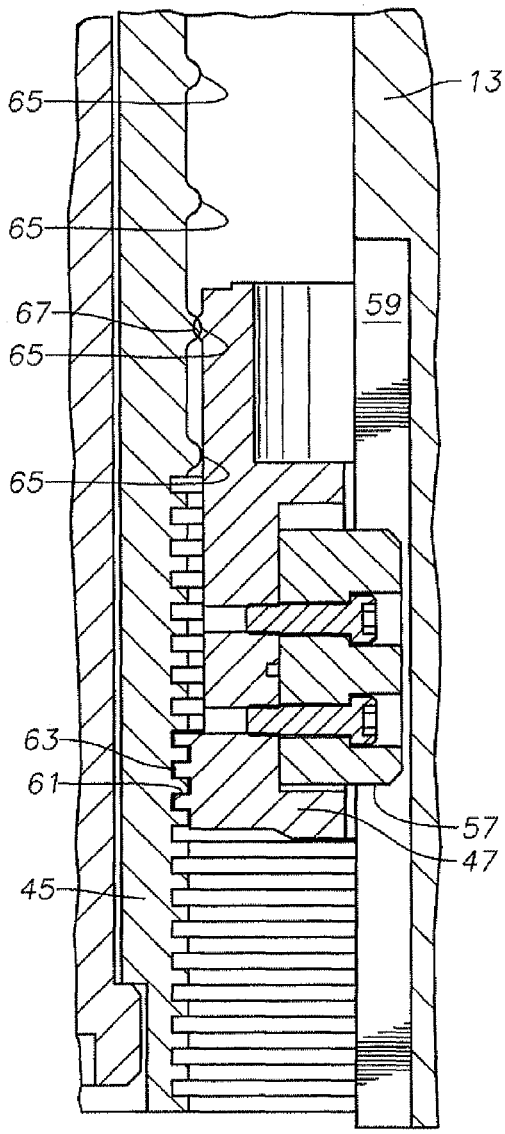
FIG. 4 is an enlarged view of a portion of the feedback mechanism in a second functional position.

As the inner cam 18 moves further longitudinally upward, the feedback cam 47 simultaneously rotates in unison with the stem 13 and also moves longitudinally upward because the mechanism body 45 is held stationary with the lower body 37. The anti rotation keys 57 connecting the feedback cam 47 to the stem 13 move further longitudinally upward in the slots 59 in the stem 13 as the feedback cam 47 moves upward relative to lower body 37 as both the stem 13 and the feedback cam 47 rotate. As the stem 13 rotates, the feedback cam 47 continues to move axially upward relative to the mechanism body 45. Referring to FIG. 4, the stem 13 and the feedback cam 47 continue to rotate, and the feedback cam 47 moves axially upward relative to the mechanism body 45 until the detent 67 on the feedback cam 47 engages the second of the plurality of detents 65 on the mechanism body 45. As the detents 65, 67 engage one another, the torque required to rotate the stem 13 relative to the outer body 31, and thus the torque required to rotate the feedback cam 47 relative to the mechanism body 45 increases. The increased torque required to rotate the stem 13 to overcome the engagement of the detents 65, 67 indicates to the operator and provides positive feedback that the stem 13 has rotated to the proper functional position relative to the outer body 31. Accordingly, the increased torque also indicates to the operator and provides positive feedback that the inner cam 18 has moved axially relative to the outer body 31 the proper amount to align the upper stem port 15 with the inner body port 20.

The operator stops rotating the stem 13 at this point. Fluid pressure is then applied down the drill pipe and travels through the axial passage 14 of stem 13 before passing through the upper stem port 15, the inner body port 20, and into the chamber of the piston 41, driving it downward relative to the stem 13. As the piston 41 moves downward, the packoff seal is set.

Figure 5:
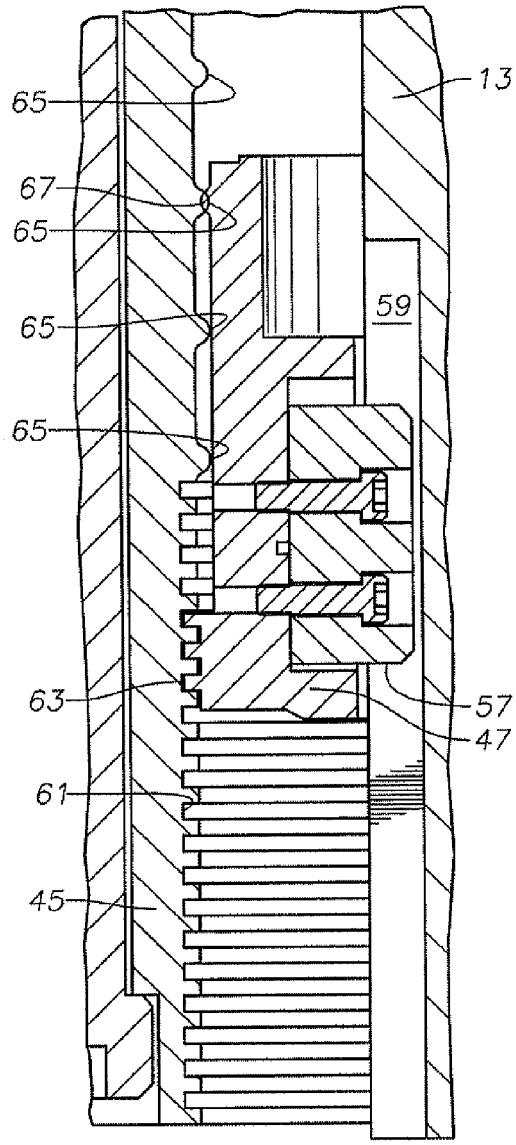
FIG. 5 is an enlarged view of a portion of the feedback mechanism in a third functional position.

Once the piston 41 is driven downward and the packoff seal is set, the stem 13 is then rotated an additional specified number of revolutions in the same direction as before. As the stem 13 is rotated relative to the body 31, the inner cam 18 and the feedback cam 47 move further longitudinally in the same direction relative to the mechanism body 45, and the detents 65, 67 that were engaged with one another disengage, decreasing the amount of torque required to rotate the stem 13 relative to the body 31. As the inner cam 18 moves further longitudinally upward, the stem ports 15, 17, the upper body port 20, the inner cam port 21, and the outer body port 32 also move relative to one another. The lower stem port 17 aligns with the inner cam port 21 and the outer body port 32, allowing fluid communication from the axial passage 14 of stem 13, through the stem 13, into and through inner cam 18, into and through the outer body 31, and into an isolated volume above the packoff seal. As the inner cam 18 moves further longitudinally upward, the feedback cam 47 simultaneously rotates in unison with the stem 13 and also moves further longitudinally upward because the mechanism body 45 is held stationary with the lower body 37. The anti rotation keys 57 connecting the feedback cam 47 to the stem 13 move further longitudinally upward in the slots 59 in the stem 13 as the feedback cam 47 moves further upward relative to the lower body 37 as both the stem 13 and the feedback cam 47 rotate. As the stem 13 rotates, the feedback cam 47 continues to move axially upward relative to the mechanism body 45. Referring to FIG. 5, the stem 13 and the feedback cam 47 continue to rotate, and the feedback cam 47 moves axially upward relative to the mechanism body 45 until the detent 67 on the feedback cam 47 engages the third of the plurality of detents 65 on the mechanism body 45. As the detents 65, 67 engage one another, the torque required to rotate the stem 13 relative to the outer body 31, and thus the torque required to rotate the feedback cam 47 relative to the mechanism body 45 increases. The increased torque required to rotate the stem 13 to overcome the engagement of the detents 65, 67 indicates to the operator and provides positive feedback that the stem 13 has rotated to the proper functional position relative to the outer body 31. Accordingly, the increased torque also indicates to the operator and provides positive feedback that the inner cam 18 has moved axially relative to the outer body 31 the proper amount to align the lower stem port 17 with the inner cam port 21 and the outer body port 32.

The operator then stops rotating stem 13 for this test portion. Pressure is applied down the drill pipe and travels through the axial passage 14 of stem 13 before passing through the lower stem port 17, the cam port 21, the body port 32, and into an isolated volume above the packoff seal, thereby testing the packoff seal. A seal (not shown) on the outer diameter of the piston 41 seals against the bore of the wellhead housing (not shown) to define the test chamber.

Figure 6:
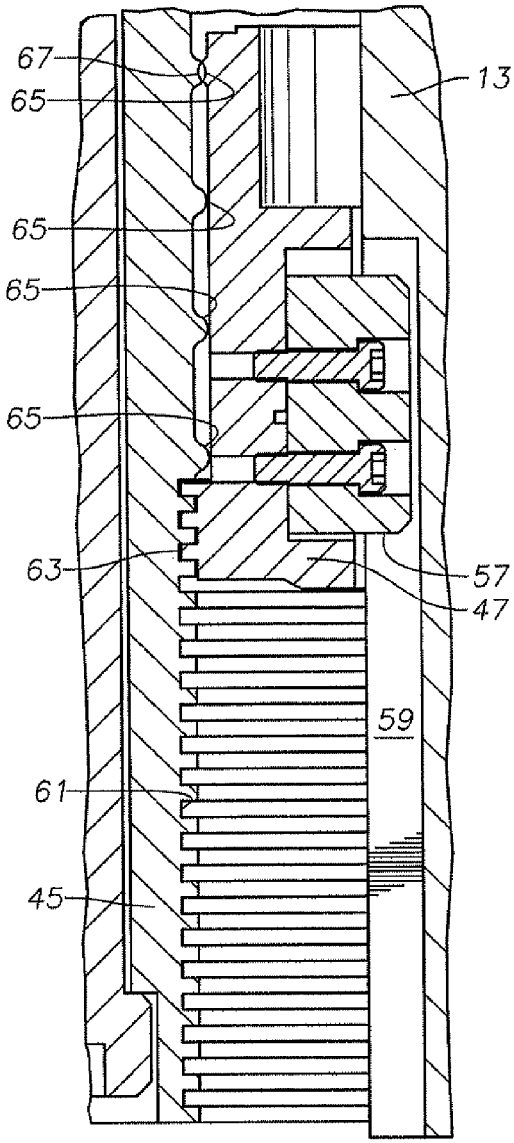
FIG. 6 is an enlarged view of a portion of the feedback mechanism in a fourth functional position.

Once the packoff seal has been tested, the stem 13 is then rotated a specified number of additional revolutions in the same direction. As the stem 13 is rotated relative to the body 31, the inner cam 18 and the feedback cam 47 move further longitudinally in the same direction relative to the mechanism body 45, and the detents 65, 67 that were engaged with one another disengage, decreasing the amount of torque required to rotate the stem 13 relative to the body 31. As the inner cam 18 moves longitudinally upward, the engagement element 33 is freed and moves radially inward into the recessed pocket 29 on the outer surface of the inner cam 18, thereby unlocking the body 31 from the casing hanger. As the inner cam 18 moves further longitudinally upward, the feedback cam 47 simultaneously rotates in unison with the stem 13 and also moves further longitudinally upward because the mechanism body 45 is held stationary with the lower body 37. The anti rotation keys 57 connecting the feedback cam 47 to the stem 13 move further longitudinally upward in the slots 59 in the stem 13 as the feedback cam 47 moves further upward relative to the lower body 37 as both the stem 13 and the feedback cam 47 rotate. As the stem 13 rotates, the feedback cam 47 continues to move axially upward relative to the mechanism body 45. Referring to FIG. 6, the stem 13 and the feedback cam 47 continue to rotate, and the feedback cam 47 moves axially upward relative to the mechanism body 45 until the detent 67 on the feedback cam 47 engages the fourth of the plurality of detents 65 on the mechanism body 45. As the detents 65, 67 engage one another, the torque required to rotate the stem 13 relative to the outer body 31, and thus the torque required to rotate the feedback cam 47 relative to the mechanism body 45 increases. The increased torque required to rotate the stem 13 to overcome the engagement of the detents 65, 67 indicates to the operator and provides positive feedback that the stem 13 has rotated to the proper functional position relative to the outer body 31. Accordingly, the increased torque also indicates to the operator and provides positive feedback that the inner cam 18 has moved axially relative to the outer body 31 the proper amount to disengage the engagement element 33 from the casing hanger.

Figure 7:
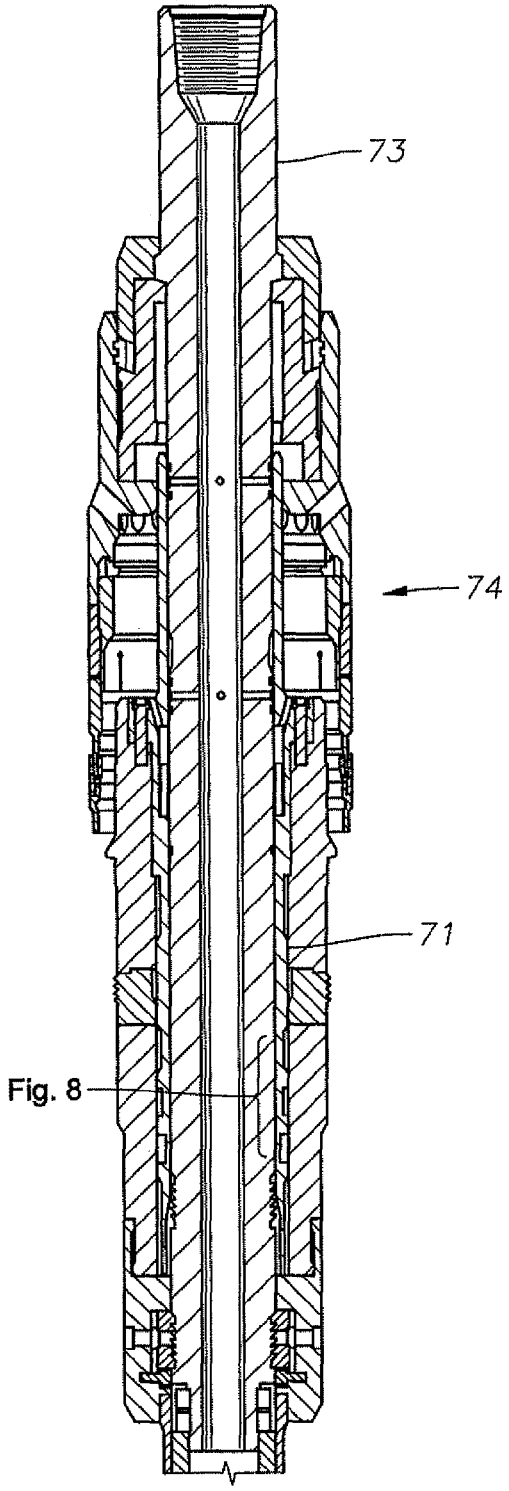
FIG. 7 is a sectional view of a running tool with a feedback mechanism constructed in accordance with an alternate embodiment of the present technique.
Figure 8:
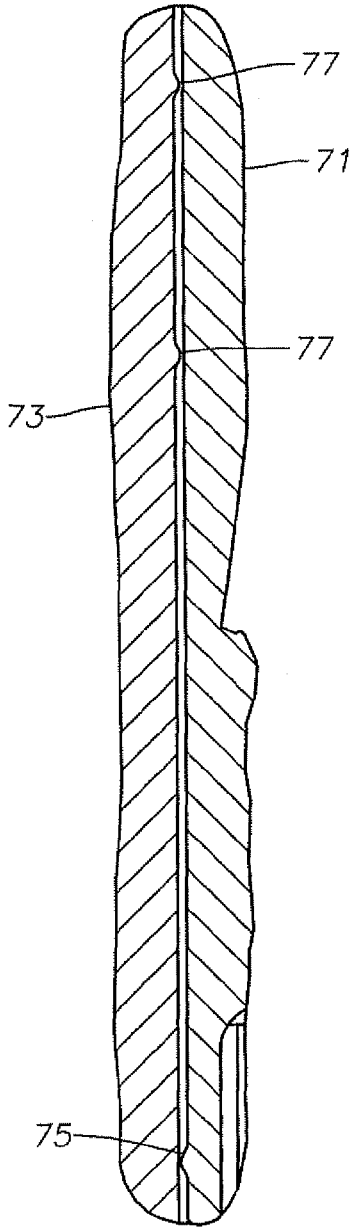
FIG. 8 is an enlarged view of a portion of the feedback mechanism of FIG. 7.

Referring to FIG. 7, in an alternate embodiment of the present technique, an inner cam 71 and a tool stem 73 of a running tool 74 are modified to incorporate a feedback mechanism. In this alternate embodiment, as illustrated in FIG. 8, the inner cam 71 has a detent 75 positioned on its inner diameter that extends radially inward to form an annular band. The stem 73 has a plurality of detents 77 that extend radially inward a select distance from the outer diameter of the tool stem 73 to form annular bands. The detents 77 are vertically spaced apart from one another at a select distance and are positioned on the outer diameter of the tool stem 73 and are adapted to engage with the detent 75 of the inner cam 71 at select positions. In operation, as the inner cam 71 and the tool stem 73 move relative to one another throughout the various operation sequences and functional positions of the running tool 74, the detent 75 of the inner cam 71 engages the plurality of detents 77 on the stem 73, thereby increasing the torque required to rotate the stem 73, and thus providing positive feedback to the operator that the components of the running tool 74 are in the proper functional positions throughout the running tool operation sequences.

The feedback mechanism of the present technique is an effective and efficient technique to provide an operator with feedback as to the movement of the components of a running tool during operation of the running tool. The technique has significant advantages. An example of these advantages includes positive indication and feedback to an operator that the components of a running tool are properly positioned throughout the various operational sequences of the running tool. Another example is that the technique can be employed in various style running tools to provide the operator with feedback.

In the drawings and specification, there have been disclosed a typical preferred embodiment of the technique, and although specific terms are employed, the terms are used in a descriptive sense only and not for purposes of limitation. The technique has been described in considerable detail with specific reference to these illustrated embodiments. It will be apparent, however, that various modifications and changes can be made within the spirit and scope of the technique as described in the foregoing specification and as set forth in the following claims.

The invention claimed is:

1. An apparatus for performing remote operations in a well, Comprising:

a running tool having a stem selectively connected to a string of conduit, the stem having a passage extending therethrough along an axis of the stem, a body, and a plurality of functional positions selected in response to rotation of the stem relative to the body; and a feedback mechanism assembly connected to the running tool and operational with rotation of the stem relative to the body, the feedback mechanism assembly selectively increasing the torque required to rotate the stem relative to the body at the plurality of functional positions, thereby providing a positive indication that the running tool is in the proper functional position of the plurality of functional positions;

an inner cam positioned between the stem and the body and connected to the stem and the body such that rotation of the stem causes the inner cam to translate axially relative to the body to the functional positions;

an engagement element, carried by the body and adapted to be engaged with a well pipe hanger, the axial movement of the inner cam relative to the body causing the engagement element to move radially outward and into engagement with the hanger to releasably secure the running tool to the hanger; and a piston, substantially surrounding portions of the stem, the inner cam, and the body and downwardly moveable relative to the stem in response to fluid pressure applied to the axial passage to thereby set a packoff seal.

2. The feedback mechanism assembly according to claim 1, wherein the feedback mechanism assembly further comprises:

a mechanism body connected to the body of the running tool, the mechanism body having a plurality of engagement elements, the plurality of engagement elements corresponding to the plurality of functional positions of the running tool; and a feedback can connected to the stem and the mechanism body such that the feedback cam rotates simultaneously with the stem and is capable of movement axially relative to the stem and the mechanism body, the feedback cam having an engagement element, the engagement element of the feedback cam adapted to engage the plurality of engagement elements of the mechanism body corresponding to the plurality of functional positions of the running tool, thereby increasing the torque required to rotate the stem relative to the body at the plurality of functional positions, thereby providing a positive indication that the running tool is in the proper functional position of the plurality of functional positions.

3. The feedback mechanism assembly according to claim 2, wherein the plurality of engagement elements of the mechanism body further comprise:

a plurality of detents extending radially, inward from an inner diameter of the mechanism body; and wherein the engagement element of the feedback cam further comprises:

a detent extending radially outward from an outer diameter of the feedback cam, the detent adapted to engage the plurality of detents of the mechanism body corresponding to the plurality of functional positions of the running tool.

4. The feedback mechanism assembly according to claim 2, wherein the running tool further comprises:

an inner cam positioned between the stem and the body and connected to the stem and the body such that rotation of the stem causes the inner cam to translate axially relative to the body to the functional positions and simultaneously causes the inner cam and the feedback cam to move axially in the same direction relative to the body.

5. The feedback mechanism assembly according to claim 1 , wherein the feedback mechanism assembly further comprises:

a plurality of engagement elements positioned on the outer diameter of the stem, the plurality of engagement elements corresponding to the plurality of functional positions of the running tool; and an engagement element positioned on the inner diameter of the body, the engagement element of the body adapted to engage the plurality of engagement elements of the stem corresponding to the plurality of functional positions of the running tool, thereby increasing the torque required to rotate the stem relative to the body at the plurality of functional positions, thereby providing a positive indication that the running tool is in the proper functional position of the plurality of functional positions.

6. The feedback mechanism assembly according to claim 5, wherein the plurality of engagement elements of the stem further comprise:

a plurality of detents extending radially outward from an outer diameter of the stem; and wherein the engagement element of the body further comprises:

a detent extending radially inward from an inner diameter of the body, the detent adapted to engage the plurality of detents of the stem corresponding to the plurality of functional positions of the running tool.

7. The feedback mechanism assembly according to claim 1, wherein the feedback mechanism assembly further comprises:

a plurality of engagement elements positioned on the outer diameter of the stem, the plurality of engagement elements corresponding to the plurality of functional positions of the running tool; and an engagement element positioned on the inner diameter of the inner cam, the engagement element of the inner cam adapted to engage the plurality of engagement elements of the stem corresponding to the plurality of functional positions of the running tool, thereby increasing the torque required to rotate the stem relative to the body at the plurality of functional positions, thereby providing a positive indication that the running tool is in the proper functional position of the plurality of functional positions.

8. The feedback mechanism assembly according to claim 7, wherein the plurality of engagement elements of the stem further comprise:

a plurality of detents extending radially outward from an outer diameter of the stem; and wherein the engagement element of the inner cam further comprises:

a detent extending radially inward from an inner diameter of the inner cam, the detent adapted to engage the plurality of detents of the stem corresponding to the plurality of functional positions of the running tool.

9. An apparatus for performing remote operations in a well, comprising:

a running tool having a stem for connecting to a string of conduit, the stem having a passage extending therethrough along an axis of the stem, a body, and a plurality of functional positions selected in response to rotation of the stem relative to the body;

a mechanism body connected to the body of the running tool, the mechanism body having a plurality of engagement elements, the plurality of engagement elements corresponding to the plurality of functional positions of the running tool; and a feedback cam connected to the stem and the mechanism body such that the feedback cam rotates simultaneously with the stem and is capable of movement axially relative to the stem and the mechanism body, the feedback cam having an engagement element, the engagement element of the feedback cam adapted to engage the plurality of engagement elements of the mechanism body corresponding to the plurality of functional positions of the running tool, thereby increasing the torque required to rotate the stem relative to the body at the plurality of functional positions, thereby providing a positive indication that the running tool is in the proper functional position of the plurality of functional positions.

10. The apparatus for performing remote operations in a well according to claim 9, the apparatus further comprising:

an inner cam positioned between the stem and the body and connected to the stem and the body such that rotation of the stem causes the inner cam to translate axially relative to the body to the functional positions;

an engagement element, carried by the body and adapted to be engaged with a well pipe hanger, the axial movement of the inner cam relative to the body causing the engagement element to move radially outward and into engagement with the hanger to releasably secure the running tool to the hanger; and a piston, substantially surrounding portions of the stem, the inner cam, and the body and downwardly moveable relative to the stem in response to fluid pressure applied to the axial passage to thereby set a packoff seal.

11. The apparatus for performing remote operations in a well according to claim 10, wherein the plurality of engagement elements of the mechanism body further comprise:

a plurality of detents extending radially inward from an inner diameter of the mechanism body; and wherein the engagement element of the feedback cam further comprises:

a detent extending radially outward from an outer diameter of the feedback cam, the detent adapted to engage the plurality of detents of the mechanism body corresponding to the plurality of functional positions of the running tool.

12. The apparatus for performing remote operations in a well according to claim 11, wherein rotation of the stem causes the inner cam to translate axially relative to the body to the functional positions and simultaneously causes the inner cam and feedback cam to move axially in the same direction relative to the body.

13. A method of performing a remote operation in a well, the method comprising:

(a) providing a running tool with an elongated stem, a body, and a feedback mechanism assembly, the running tool having a plurality of functional positions selected in response to rotation of the stem relative to the body;

(b) connecting the stem to a string of conduit and running the tool into a subsea wellhead; then (c) rotating the conduit and the stem relative to the body to one of the plurality of functional positions, the feedback mechanism increasing the torque required to rotate the conduit and the stem relative to the body when the running tool reaches the one of the plurality of functional positions, thereby providing a positive indication and feedback that the running tool is in the one of the plurality of functional positions.

14. The method of claim 13, wherein the feedback mechanism assembly comprises:

a mechanism body connected to the body of the running tool, the mechanism body having a plurality of engagement elements, the plurality of engagement elements corresponding to the plurality of functional positions of the running tool; and a feedback cam connected to the stem and the mechanism body, the feedback cam having an engagement element; and wherein step (c) further comprises:

moving the feedback cam axially relative to the body and the mechanism body in response to the rotation of the stem relative to the body, thereby engaging the engagement element of the feedback cam with one of the plurality of engagement elements of the mechanism body when the running tool reaches the one of the plurality of functional positions, thereby increasing the torque required to rotate the conduit and the stem relative to the body and providing a positive indication and feedback that the running tool is in the one of the plurality of functional positions.

15. The method according to claim 14, wherein the plurality of engagement elements of the mechanism body further comprise:

a plurality of detents extending radially inward from an inner diameter of the mechanism body; and wherein the engagement element of the feedback cam further comprises:

a detent extending radially outward from an outer diameter of the feedback cam.

16. The method of claim 13, wherein:

step (a) further comprises providing the running tool with a piston substantially surrounding portions of the stem and the body and downwardly moveable relative to the stem, and an inner cam positioned between the stem and the body and connected to the stem and the body such that rotation of the stem causes the inner can to translate axially relative to the body to the plurality of functional positions;

prior to step (b), rotating the stem relative to the body, thereby securely engaging the running tool with a well pipe hanger; and step (c) further comprises moving the piston downward relative to the stem to set a packoff.

17. The method of claim 13, wherein step (a) further comprises providing the running tool with an inner cam positioned between the stem and the body and connected to the stem and the body such that rotation of the stem causes the inner cam to translate axially relative to the body to the plurality of functional positions; and wherein the feedback mechanism assembly further comprises:

a plurality of engagement elements positioned on the outer diameter of the stem, the plurality of engagement elements corresponding to the plurality of functional positions of the running tool; and an engagement element positioned on the inner diameter of the inner cam; and wherein step (c) further comprises:

moving the inner cam axially relative to the body and the stem in response to the rotation of the stem relative to the body, thereby engaging the engagement element of the inner cam with one of the plurality of engagement elements of the stem when the running tool reaches the one of the plurality of functional positions, thereby increasing the torque required to rotate the conduit and the stem relative to the body and providing a positive indication and feedback that the running tool is in the one of the plurality of functional positions.

18. The method according to claim 17, wherein the plurality of engagement elements of the stem further comprise:

a plurality of detents extending radially outward from an outer diameter of the stem; and wherein the engagement element of the inner cam further comprises:

a detent extending radially inward from an inner diameter of the inner cam.

* * * * *